US006435817B1

(12) United States Patent
Hollenbeck et al.

(10) Patent No.: US 6,435,817 B1
(45) Date of Patent: Aug. 20, 2002

(54) METHODS AND APPARATUS FOR REDUCING VIBRATIONS INDUCED WITHIN FAN ASSEMBLIES

(75) Inventors: Robert Keith Hollenbeck; James Everett Grimm; David L. Smith; Kerry B. Shelton, all of Fort Wayne, IN (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/596,982

(22) Filed: Jun. 20, 2000

(51) Int. Cl.[7] ..... F04D 29/66
(52) U.S. Cl. ..... 415/119; 416/169 A
(58) Field of Search ..... 415/119; 416/169 A, 416/500

(56) References Cited

U.S. PATENT DOCUMENTS 2,680,559 A * 6/1954 Morrill ..... 416/169 A
5,460,485 A * 10/1995 Sugiyama et al. ..... 416/169 A
5,558,298 A * 9/1996 Pla et al. ..... 415/119
5,582,507 A * 12/1996 Alizadeh ..... 416/169 R

* cited by examiner

*Primary Examiner*—John Kwon
(74) *Attorney, Agent, or Firm*—Karl Vick, Esq.; Damian Wasserbauer, Esq.; Armstrong Teasdale LLP

(57) ABSTRACT

A fan assembly includes a vibration damping system to reduce induced vibrational energy generated as a result of fan motor operation. The vibration damping system includes a plurality of arms and damping material. The vibration damping system arms extend between a fan motor housing and a shroud assembly disposed circumferentially outward from the fan motor housing. The damping material is attached to an end of each of the vibration damping system arms and connects each arm to the shroud assembly. The damping material absorbs induced vibrational energy generated by fan motor operation.

36 Claims, 4 Drawing Sheets

METHODS AND APPARATUS FOR REDUCING VIBRATIONS INDUCED WITHIN FAN ASSEMBLIES

BACKGROUND OF THE INVENTION

This application relates generally to fan assemblies and, more particularly, to vibration damping systems for use with fan assemblies.

Fan assemblies typically include a fan, a motor, a fan control, and a motor housing. The fan motor and control are positioned within the motor housing and control the energization and rotation of the fan. Because fan assemblies are often used in applications which demand high air flows, fans are typically operated at high rotational speeds to provide sufficient airflow to the component. Fan imbalances and motor torque pulsations generated by such fan assemblies produce vibrations which may produce undesirable noise when conducted through mounting systems used to mount such fan assemblies within the applications.

The motors generating such operating speeds may induce potentially damaging vibrations into the fan assemblies which sometimes loosen from the component as a result of continued exposure to such vibrations. Loosening of the component may cause the associated fan assembly or the component to fail.

To prevent such failures, typically damping systems are attached to the components to minimize the effects of the induced vibrational energy from the fan motor. Such systems are intricate and expensive, and over time, continued exposure to vibrational energy may cause the damping systems to fail, allowing the vibrational energy to loosen the fan assembly from the component, potentially leading to failures of the fan assembly or the component.

BRIEF SUMMARY OF THE INVENTION

In an exemplary embodiment, a fan assembly includes a vibration damping system to reduce induced vibrational energy from being induced within an application or component plenum. The fan assembly is mounted to a component plenum and includes a fan, a shroud assembly and a fan motor housing. The shroud assembly includes a shroud disposed circumferentially outward from the fan motor housing. The fan includes a plurality of blades extending from the motor housing and driven by a motor housed within the motor housing. The vibration damping system includes a plurality of arms and damping material. The vibration damping system arms extend between the fan motor housing and the shroud assembly. The damping material is attached to an end of each of the vibration damping system arms and connects each arm to the shroud assembly.

During operation, as the fan motor operates, vibrations are induced from the motor into the shroud assembly. The damping material absorbs motor induced vibrational energy and the combination of the damping material and the vibration damping system arms reduce vibrational energy to prevent such energy from exciting the component plenum. As a result, a fan assembly is provided that is reliable and cost-effective.

DETAILED DESCRIPTION OF THE INVENTION

Figure 1:
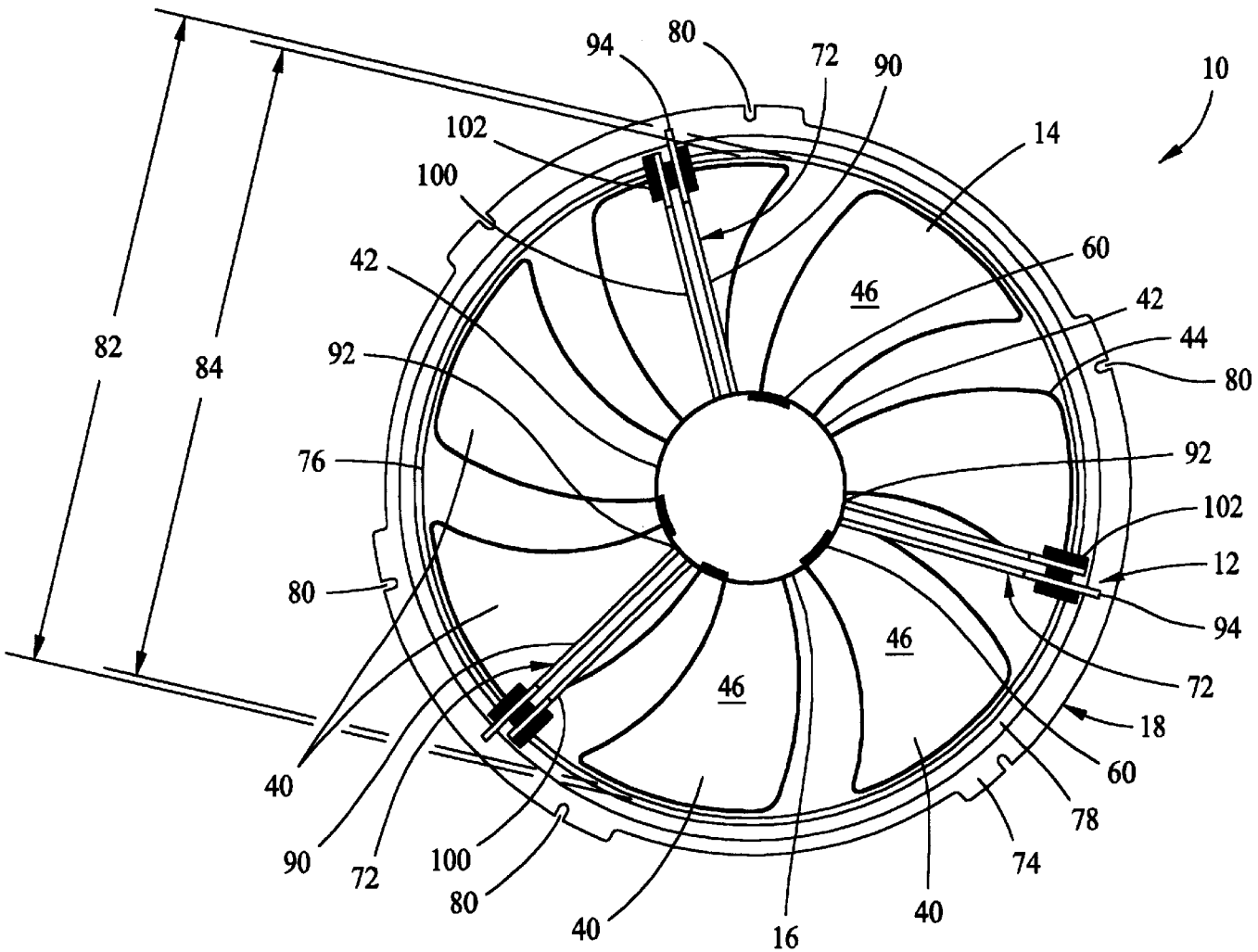
FIG. 1 is a rear elevational view of a fan assembly including a vibration damping system.
Figure 2:
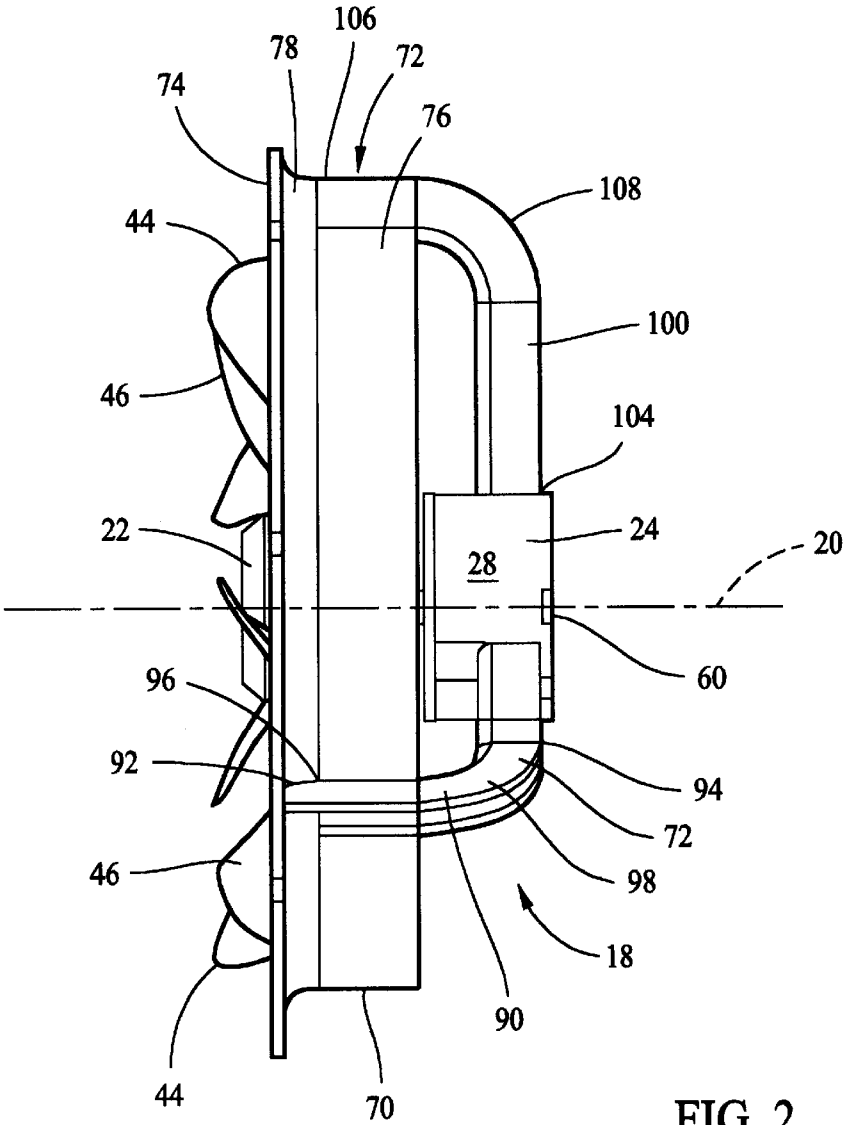
FIG. 2 is a side elevational view of the fan assembly shown in FIG. 1.

FIGS. 1 and 2 are a rear elevational view and a side elevational view, respectively, of a fan assembly 10 including a vibration damping system 12. Fan assembly 10 includes a motor (not shown), a control (not shown), a fan 14, a motor housing 16, and a shroud assembly 18. The motor and fan control are disposed within motor housing 16 and control energization and rotation of fan 14 about an axis of rotation 20.

Motor housing 16 includes a rotating portion 22 and a stationary or shroud cup portion 24. Stationary portion 24 is substantially cylindrical and includes a top 26, a side wall 28, and a bottom flange (not shown). Side wall 28 extends substantially perpendicularly from top 26 to the bottom flange. The bottom flange extends radially outward from side wall 28 and permits stationary portion 24 to be in sealable and rotating contact with rotating portion 22.

Fan 14 is attached to rotating portion 22 and includes a plurality of fan blades 40 extending outward from rotating portion 22. Each fan blade 40 includes a root 42 attached to rotating portion 22, a tip 44, and a body 46 extending between fan root 42 and fan tip 44. Blades 40 are evenly spaced circumferentially around rotating portion 22. In one embodiment, fan 14 is an axial flow fan.

Stationary portion 24 is downstream from rotating portion 22 and includes a plurality of snap-fit release/attachment fittings 60 spaced circumferentially around side wall 28 and extending into stationary portion top 24. Snap-fit release fittings 60 maintain motor housing rotating portion 22 in a snap-fit relationship with motor housing stationary portion 24. Snap-fit release fittings 60 also permit moisture to drain from motor housing 16 to the environment. In another embodiment, motor housing rotating portion 22 snap-fits to motor housing stationary portion 24 with a 360° snap ring (not shown).

Shroud assembly 18 extends from motor housing 16 and permits fan assembly 10 to mount within a component (not shown) such that fan assembly 10 avoids contact with the component. In one embodiment, the component is a refrigerator assembly. Shroud assembly 18 includes a shroud 70 and a mounting suspension 72. Shroud 70 is generally circular and is disposed circumferentially outward from motor housing 16.

Shroud 70 includes a first body portion 74, a second body portion 76, and a third body portion 78. Second body portion 76 is substantially perpendicular to first body portion 74 and extends from third body portion 78. Third body portion 78 slopes between first body portion 74 and second body portion 76. First body portion 74 is a substantially planar flange and includes a plurality of attachment points 80 spaced circumferentially around first body portion 74. Fasteners (not shown) extend through opening 80 and attach shroud 70 to a plenum (not shown), and thus, mount fan assembly 10 within the component. Shroud second body portion 76 is substantially cylindrical and defines an inner diameter 82 larger than an outer diameter 84 of fan 14. Accordingly, because diameter 82 is larger than diameter 84, fan blades 40 rotate without contacting shroud 70.

Mounting suspension 72 includes a plurality of legs 90 extending between shroud 70 and motor housing stationary portion 24. Legs 90 are evenly spaced circumferentially around motor housing stationary portion 24 and secure shroud 70 to motor housing 16. In one embodiment, mounting suspension 72 includes three legs 90.

Each leg 90 includes a first end 92 and a second end 94. Leg first ends 92 are adjacent motor housing 16 and leg second ends 94 are adjacent shroud 70. Each leg second end 94 includes a tapered portion 96 that permits each leg second end 94 to contact shroud first body portion 74 while mounting flush against shroud second and third body portions 76 and 78, respectively. Each leg 90 also includes an elbow 98 curved such that each leg second end 94 is located upstream from each leg first end 92.

Vibration damping system 12 includes a plurality of arms 100 and damping material 102. In one embodiment, vibration damping system 12 includes three arms 100. Vibration damping system arms 100 extend between motor housing 16 and shroud assembly 18. Each arm 100 includes a first end 104, a second end 106, and a curved elbow 108. Each arm first end 104 is adjacent motor housing 16 and each second end 106 is adjacent shroud assembly 18. Because elbow 108 is curved, each arm second end 106 is located upstream from arm first end 104. In one embodiment, each vibration damping system arm 100 has a contour substantially similar to a contour of each mounting suspension leg 90. Each arm 100 is shorter than each mounting suspension leg 90 such that each second end 106 mounts against shroud second body portion 76. At least one vibration damping system arm 100 is positioned between adjacent mounting suspension legs 90.

Damping material 102 is attached to each vibration damping system arm second end 106 adjacent shroud assembly 18. In an exemplary embodiment, damping material 102 connects each vibration damping system arm 100 to each mounting suspension leg 90 such that damping material 102 extends between each vibration damping system arm second end 106 and each mounting suspension leg second end 94. In one embodiment, damping material 102 is a plastic material selected to absorb vibration produced forces.

In operation, vibration damping system 12 is attached to fan assembly 10 such that at least one vibration damping system arm 100 extends from motor housing 16 to shroud 70 and is positioned between a pair of adjacent mounting suspension legs 90. In the exemplary embodiment, at least one vibration damping system arm 100 is positioned between each pair of adjacent mounting suspension legs 90. Damping material 102 is attached to each vibration damping system arm second end 106 and connects each vibration damping system arm 100 to each mounting suspension leg 90 at each mounting suspension leg second end 94. In one embodiment, damping material 102 is an energy absorbing plastic material.

As fan 12 rotates, fan blades 40 rotate simultaneously with motor housing rotating portion 22. As the fan motor operates, vibrations are induced from the motor into mounting suspension legs 90. Specifically, mounting suspension leg 90 attached to shroud 70 provides a stationary connection between the component plenum and shroud 70 such that any torsional vibrational energy generated during operation is transmitted into arm second end damping material 102. Damping material 102 absorbs motor induced vibrational energy and the combination of damping material 102 and vibration damping system arms 100 reduce induced vibrational energy and prevent such energy from exciting the component plenum.

Figure 3:
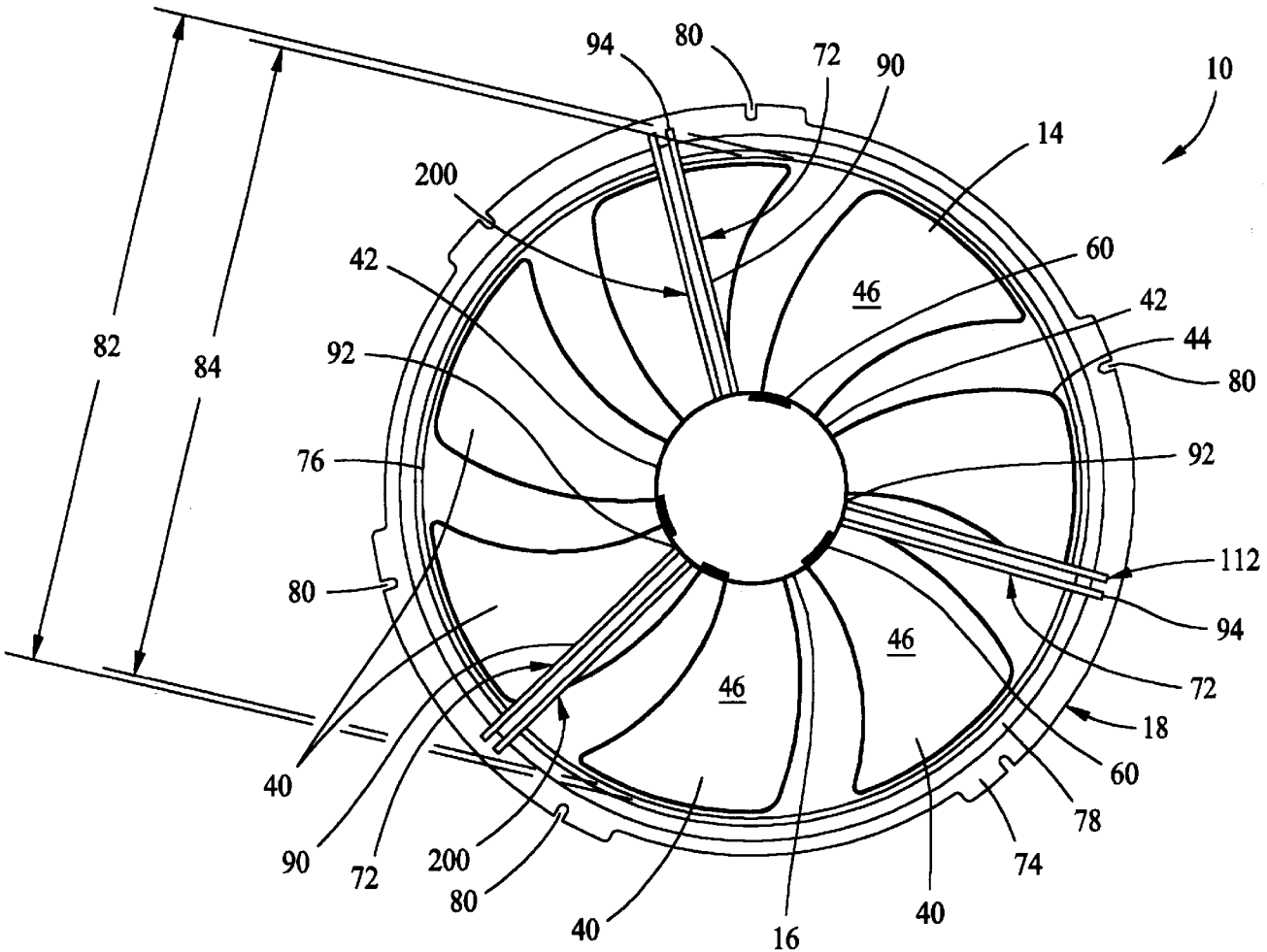
FIG. 3 is a rear elevational view of a fan assembly including an alternative embodiment of a vibration damping system.
Figure 4:
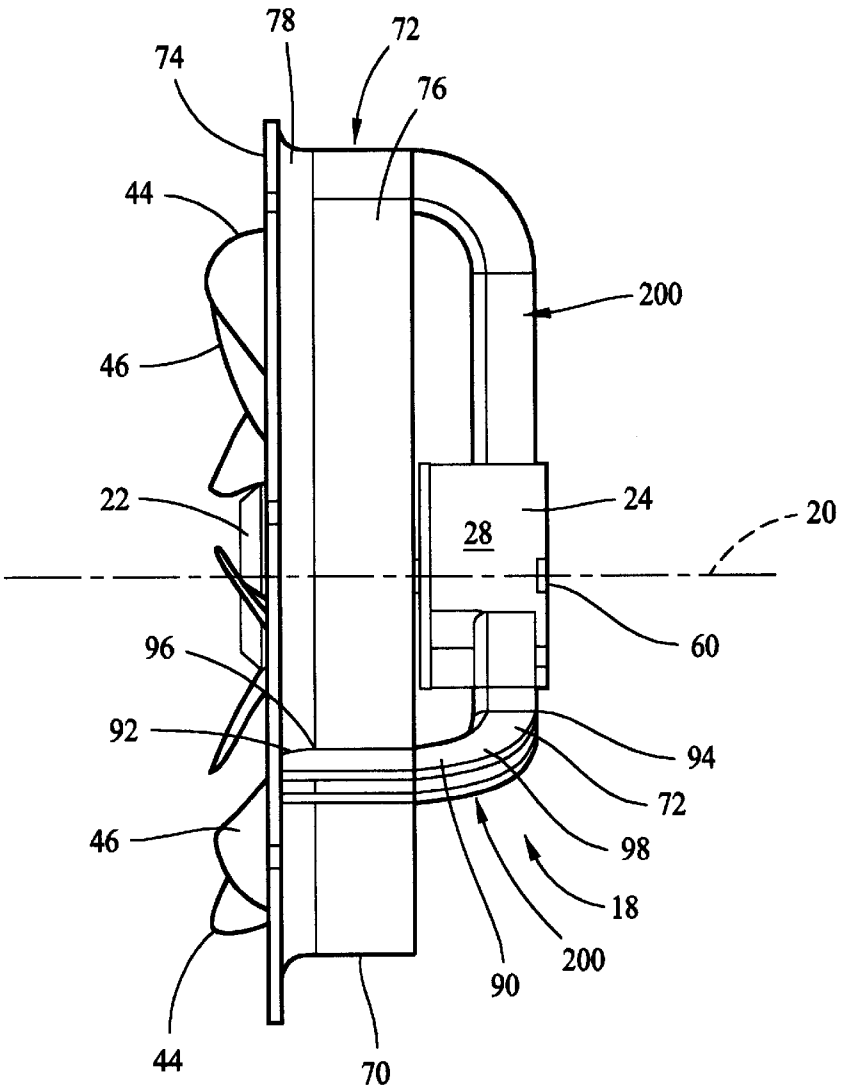
FIG. 4 is a side elevational view of the fan assembly shown in FIG. 3.

FIGS. 3 and 4 are a rear elevational view and a side elevational view, respectively, of a fan assembly 10. Fan assembly 10 includes a motor (not shown), a control (not shown), a fan 14, a motor housing 16, and a shroud assembly 18. The motor and fan control are disposed within motor housing 16 and control energization and rotation of fan 14 about an axis of rotation 20.

Motor housing 16 includes a rotating portion 22 and a stationary or shroud cup portion 24. Stationary portion 24 is substantially cylindrical and includes a top 26, a side wall 28, and a bottom flange (not shown). Side wall 28 extends substantially perpendicularly from top 26 to the bottom flange. The bottom flange extends radially outward from side wall 28 and permits stationary portion 24 to be in sealable and rotating contact with rotating portion 22.

Fan 14 is attached to rotating portion 22 and includes a plurality of fan blades 40 extending outward from rotating portion 22. Each fan blade 40 includes a root 42 attached to rotating portion 22, a tip 44, and a body 46 extending between fan root 42 and fan tip 44. Blades 40 are evenly spaced circumferentially around rotating portion 22. In one embodiment, fan 14 is an axial flow fan.

Stationary portion 24 is downstream from rotating portion 22 and includes a plurality of snap-fit release/attachment fittings 60 spaced circumferentially around side wall 28 and extending into stationary portion top 24. Snap-fit release fittings 60 permit motor housing rotating portion 22 to snap-fit to motor housing stationary portion 24 and also permit moisture to drain from motor housing 16 to the environment. In another embodiment, motor housing rotating portion 22 snap-fits to motor housing stationary portion 24 with a 360° snap ring (not shown).

Shroud assembly 18 extends from motor housing 16 and permits fan assembly 10 to mount within a component (not shown) such that fan assembly 10 avoids contact with the component. In one embodiment, the component is a refrigerator assembly. Shroud assembly 18 includes a shroud 70 and a mounting suspension 72. Shroud 70 is generally circular and is disposed circumferentially outward from motor housing 16.

Shroud 70 includes a first body portion 74, a second body portion 76, and a third body portion 78. Second body portion 76 is substantially perpendicular to first body portion 74 and extends from third body portion 78. Third body portion 78 slopes between first body portion 74 and second body portion 76. First body portion 74 is a substantially planar flange and includes a plurality of attachment points 80 spaced circumferentially around first body portion 74. Attachment points 80 permit fasteners (not shown) to attach shroud 70 to a plenum (not shown), and thus, mount fan assembly 10 within the component. Shroud second body portion 76 is substantially cylindrical and defines an inner diameter 82 larger than an outer diameter 84 of fan 14. Accordingly, because diameter 82 is larger than diameter 84, fan blades 40 rotate without contacting shroud 70.

Mounting suspension 72 includes a plurality of legs 90 extending between shroud 70 and motor housing stationary portion 24. Each leg 90 includes a first end 92 and a second end 94. Leg first ends 92 are adjacent motor housing 16 and leg second ends 94 are adjacent shroud 70. Each leg second end 94 includes a tapered portion 96 that permits each leg second end 94 to contact shroud first body portion 74 while mounting flush against shroud second and third body portions 76 and 78, respectively. Each leg 90 also includes an elbow 98 curved such that each leg second end 94 is located upstream from each leg first end 92.

Legs 90 are arranged in pairs 200 spaced evenly around shroud 70. In one embodiment, mounting suspension 72 includes three pairs 200 of legs 90. Each pair 200 of legs 90 provides stiffness to support fan assembly 10. Furthermore, each pair 200 of legs 90 is fabricated from a damping material that absorbs vibration produced forces. In one embodiment, the damping material is an energy absorbing plastic material selected to absorb vibration produced forces.

In an exemplary embodiment, shroud assembly 18 and mounting suspension 72 are formed unitarily and are fabricated from a damping material that absorbs vibration produced forces. The damping material is an energy absorbing plastic material.

During operation, vibration damping is accomplished through legs 90. Furthermore, because mounting suspension legs 90 are arranged in pairs 200 spaced evenly around shroud assembly 18 and fabricated from a damping material, torsional vibrational energy generated during operation is damped. Additionally, legs 90 provide support and stiffness for fan assembly 10 to reduce out of phase vibration components. As a result, during operation, vibrations induced by the fan motor are reduced with mounting suspension 72. For example, vibrations induced by the fan motor traverse legs 90 radially outward towards shroud assembly 18, but before such vibrations reach shroud 70, legs 90 substantially reduce the vibrations.

The above described fan assembly is cost effective and reliable. The fan assembly includes a shroud assembly and a vibration damping system. The shroud assembly permits the fan assembly to be mounted to a component plenum and the vibration damping system prevents motor induced vibrations from exciting the component plenum. The vibration damping system includes a plurality of legs extending from the motor housing and including damping material to absorb the motor induced vibrational energy. When attached, the vibration damping system prevents motor induced vibrational energy from adversely exciting the component plenum as the fan operates. As a result, the fan assembly provided is more reliable and cost-effective than known fan assemblies.

While the invention has been described in terms of various specific embodiments, those skilled in the art will recognize that the invention can be practiced with modification within the spirit and scope of the claims.

What is claimed is:

1. A method for reducing vibrations induced within a fan assembly using a system to damp vibrations, the fan assembly including a motor housing, a fan including a plurality of blades extending from the motor housing, and a shroud assembly including a shroud and a mounting suspension, the system including a plurality of members, said method comprising the steps of:

attaching the system members to the fan assembly to reduce vibration excitations within the shroud assembly;

providing damping material to at least one system member; and operating the fan.

2. A method in accordance with claim 1 wherein said step of attaching the system members further comprises the step of attaching the system members between the motor housing and the fan assembly shroud.

3. A method in accordance with claim 2 wherein said step of providing material further comprises the step of attaching damping material to each system member.

4. A method in accordance with claim 1 wherein each system member includes a first end adjacent the motor housing and a second end adjacent the fan assembly shroud, said method further comprising the step of attaching damping material to the second end of at least one system member.

5. A method in accordance with claim 4 wherein said step of attaching damping material to the second end further comprises the step of attaching damping material to the second end of each system member.

6. A method in accordance with claim 5 wherein the fan assembly includes a mounting suspension, said step of providing damping material further comprising the step of attaching the damping material to the mounting suspension.

7. A method in accordance with claim 6 wherein said step of providing damping material further comprises connecting each system member to the mounting suspension with the damping material.

8. A fan assembly comprising:

a fan comprising a plurality of blades;

a motor housing, said plurality of blades extending radially outward from said motor housing;

a shroud assembly comprising a shroud and a mounting suspension; and a system comprising a plurality of first members attached to said fan assembly and configured to reduce vibration excitations within said shroud assembly, wherein said plurality of first members extend between said motor housing and said fan assembly shroud.

9. A fan assembly in accordance with claim 8 wherein said system further comprises damping material attached to said fan assembly.

10. A fan assembly in accordance with claim 8 wherein said vibration damping material attached to said plurality of first members, said mounting suspension comprises a plurality of struts extending between said shroud flange and said motor housing.

11. A fan assembly in accordance with claim 10 wherein each of said vibration damping material plurality of first members comprise a first end and a second end, said first member first ends adjacent said motor housing, said first member second ends adjacent said shroud flange.

12. A fan assembly in accordance with claim 11 further comprising damping material attached to at least one end of said plurality of first members.

13. A fan assembly in accordance with claim 11 wherein said damping material attached to said plurality of first member second ends.

14. A fan assembly in accordance with claim 10 wherein said damping material connects each of said plurality of first members to said fan assembly.

15. A fan assembly in accordance with claim 14 wherein said damping material connects each of said first member second ends to said mounting suspension plurality of struts.

16. A fan assembly in accordance with claim 8 wherein said damping system plurality of first members comprises three members.

17. A fan assembly in accordance with claim 9 wherein said damping material attached to at least one of said plurality of vibration damping plurality of first members.

18. A fan assembly in accordance with claim 17 wherein said damping material attached to each of said plurality of plurality of first members.

19. A fan assembly in accordance with claim 8 wherein said mounting suspension comprises a plurality of second members.

20. A fan assembly in accordance with claim 19 wherein said plurality of second members extend between said motor housing and said fan assembly shroud.

21. A fan assembly in accordance with claim 19 wherein said system plurality of second member identical with said plurality of first members.

22. A fan assembly in accordance with claim 19 wherein each of said system plurality of first members and said plurality of second members fabricated from a vibration damping material.

23. A fan assembly in accordance with claim 8 wherein said plurality of first members comprises six members arranged in pairs.

24. A fan assembly in accordance with claim 23 wherein said plurality of first members fabricated from a vibration damping material.

25. A fan assembly in accordance with claim 8 wherein said fan shroud assembly fabricated from a vibration damping material.

26. An apparatus for a fan motor housing, a shroud circumferentially disposed around the fan motor housing, said apparatus connected between the fan motor housing and the shroud, said apparatus configured to reduce vibrations induced from said motor housing into said shroud, said apparatus comprising a plurality of first members connected to the fan motor housing.

27. An apparatus in accordance with claim 26 wherein said damping material connected to at least one of said plurality of first members.

28. An apparatus in accordance with claim 27 wherein said damping material connected to each of said plurality of first members.

29. An apparatus in accordance with claim 28 wherein said damping material disposed adjacent the shroud.

30. An apparatus in accordance with claim 29 wherein said plurality of first members comprises three members.

31. An apparatus in accordance with claim 28 wherein the shroud includes a plurality of struts, said damping material connected between at least one of said first members and at least one shroud strut.

32. An apparatus in accordance with claim 31 wherein said damping material connected between each of said first members and each shroud strut.

33. An apparatus in accordance with claim 32 wherein said plurality of first members comprise six members.

34. An apparatus in accordance with claim 33 wherein said damping material disposed adjacent the shroud.

35. An apparatus in accordance with claim 26 wherein said apparatus fabricated from a damping material.

36. An apparatus in accordance with claim 26 wherein the shroud fabricated from a damping material, said apparatus fabricated from the same damping material.

* * * * *